US005150490A

United States Patent [19]

Busch et al.

[11] Patent Number: 5,150,490

[45] Date of Patent: Sep. 29, 1992

[54] PROCESS FOR PRODUCING A RESILIENT OR PADDED INSERT FOR FOOTWEAR

[75] Inventors: Waldemar Busch, Heilbronn-Böckingen; Norbert Lutz, Postbauer-Heng, both of Fed. Rep. of Germany

[73] Assignee: Storopack Hans Reichenecker GmbH & Co., Weinstadt, Fed. Rep. of Germany

[21] Appl. No.: 499,411

[22] PCT Filed: Jan. 7, 1989

[86] PCT No.: PCT/EP89/00008

§ 371 Date: Jun. 19, 1990

§ 102(e) Date: Jun. 19, 1990

[87] PCT Pub. No.: WO89/06501

PCT Pub. Date: Jul. 27, 1989

[30] Foreign Application Priority Data

Jan. 25, 1988 [DE] Fed. Rep. of Germany ..... 3802035

[51] Int. Cl.[5] ..... A43D 9/00; A43B 13/38

[52] U.S. Cl. ..... 12/146 M; 36/43; 36/71

[58] Field of Search ..... 36/43, 44, 71, 88; 12/142 N, 146 M; 264/223

[56] References Cited

U.S. PATENT DOCUMENTS

| | | | |
|---|---|---|---|
| 2,092,909 | 9/1937 | Daniels | 12/146 M |
| 2,742,657 | 4/1956 | Sloane | 264/223 X |
| 3,227,795 | 1/1966 | Ingersoll | 264/223 |
| 3,641,688 | 2/1972 | von den Benken | 36/88 X |
| 3,760,056 | 9/1973 | Rudy | 36/71 X |
| 3,765,422 | 10/1973 | Smith | 36/29 X |
| 3,798,799 | 3/1974 | Hanson et al. | 36/71 X |
| 3,848,287 | 11/1974 | Simonsen | 36/88 X |
| 3,882,561 | 5/1975 | Hanson et al. | 12/142 P |
| 3,895,405 | 7/1975 | Edwards | 36/88 X |
| 4,038,762 | 8/1977 | Swan, Jr. | 36/71 X |
| 4,108,928 | 8/1978 | Swan, Jr. | 36/71 X |
| 4,120,064 | 10/1978 | Salomon | 36/93 X |
| 4,128,951 | 12/1978 | Tansill | 36/88 X |
| 4,243,754 | 1/1981 | Swan, Jr. | 264/223 X |
| 4,252,910 | 2/1981 | Schaefer | 36/71 X |
| 4,257,176 | 3/1981 | Hartung et al. | 36/3 B X |
| 4,433,494 | 2/1984 | Courvoisier et al. | 36/119 |
| 4,502,234 | 3/1985 | Schaefer et al. | 36/28 |
| 4,510,699 | 4/1985 | Nakamura et al. | 36/43 |
| 4,513,518 | 4/1985 | Jalbert et al. | 36/43 X |
| 4,658,515 | 4/1987 | Oatman | 36/43 X |
| 4,669,142 | 6/1987 | Meyer | 12/146 M X |
| 4,674,206 | 6/1987 | Lyden | 36/88 |
| 4,716,662 | 1/1988 | Bar | 264/223 X |
| 4,756,096 | 7/1988 | Meyer | 36/88 X |
| 4,862,605 | 9/1989 | Gardner | 36/88 X |
| 4,925,724 | 5/1990 | Ogden | 36/44 X |
| 5,042,100 | 8/1991 | Bar et al. | 12/146 M |

FOREIGN PATENT DOCUMENTS

| | | | |
|---|---|---|---|
| 0000886 | 11/1979 | World Int. Prop. O. | 36/88 |

*Primary Examiner*—Paul T. Sewell
*Assistant Examiner*—Ted Kavanaugh
*Attorney, Agent, or Firm*—Jones, Tullar & Cooper

[57] ABSTRACT

A cushioning or padding body for insertion into footwear, a method of manufacturing the body and a method for the simultaneous manufacture and exact fitting of the body to the respective shape of a corresponding part of the foot of the wearer are related. The body comprises a plurality of individual foam material beads alone or a mixture of a plurality of individual foam material beads and a resiliently cushioning, thermoplastically non-deformable plastic material. The beads are each provided with a closed surface and each is generally impermeable to air. The beads are fixed in their position relative to each other by the effect of that.

21 Claims, 1 Drawing Sheet

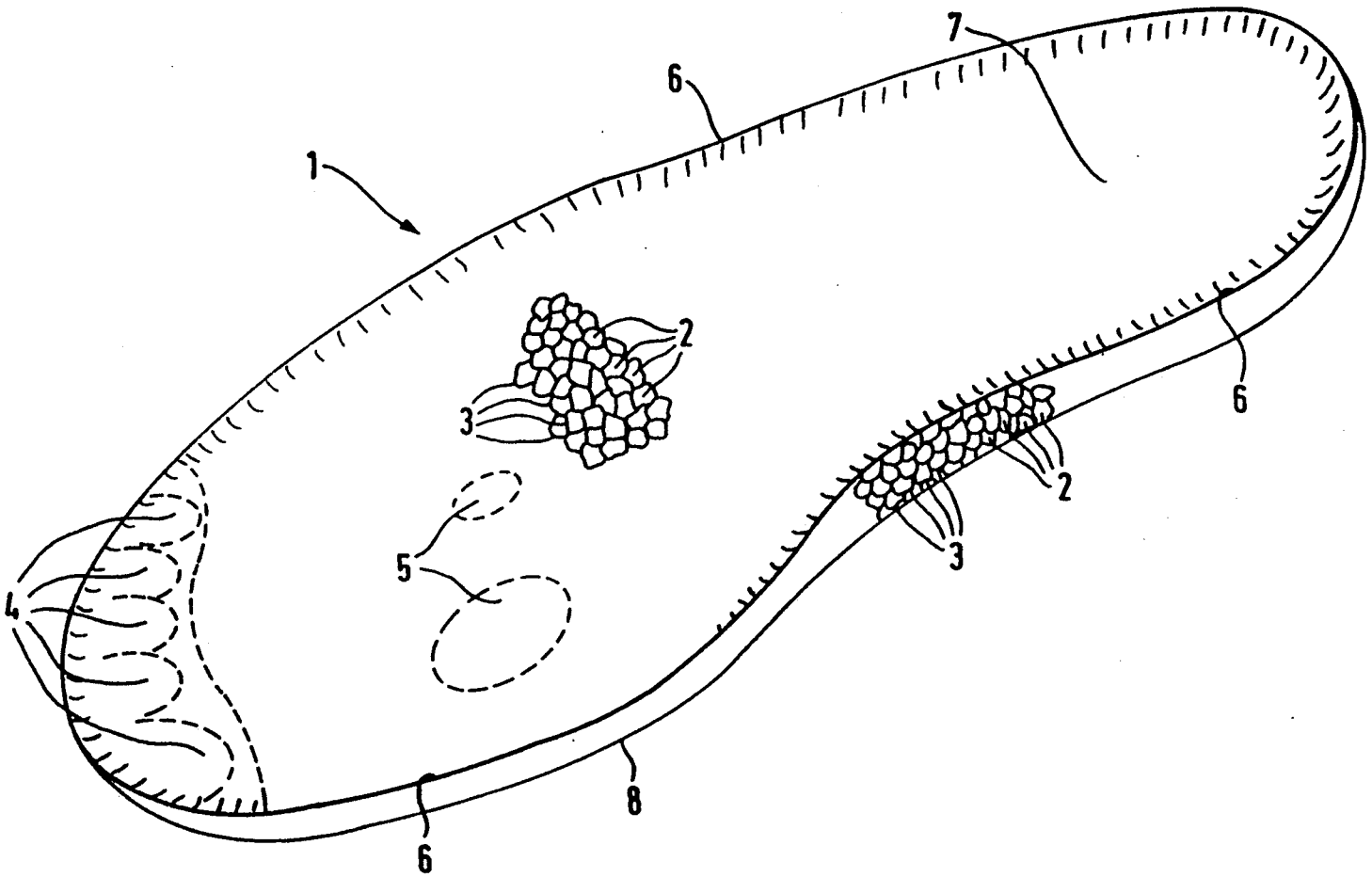
1
2
3
4
5
6
7
8

PROCESS FOR PRODUCING A RESILIENT OR PADDED INSERT FOR FOOTWEAR

BACKGROUND OF THE INVENTION

The invention relates to a cushioning or padding body for insertion into shoes, such as for example an insole, a foot support, an inner shoe for ski boots, or the like.

Such cushioning or padding bodies may be manufactured from various materials. Examples are natural materials, such as cork, rubber or the like, as well as resiliently cushioning materials of plastic and in particular of foam.

For reasons of, for example, simplicity in manufacturing as well as for the individual adaptation of such cushioning or padding bodies to the corresponding anatomical shape of the wearer, it has already been attempted to manufacture the respective shaped parts from a thermoplastically deformable, resiliently cushioning foam material. However, problems arise with such a manufacture. As a rule, thermoplastically deformable materials having a relative density suitable for practical use are not sufficiently stable. During use of the shaped parts formed from the thermoplastically deformable material, the interior structure of the foam material collapses sooner or later due to constant stress, because of which the characteristic shape and cushioning properties of the body are lost. If, to increase stability, the relative density of the foam material is increased, the resiliently cushioning properties decrease to such an extent that the shaped part is no longer satisfactorily usable as a cushioning or padding body.

Although it is possible to manufacture cushioning and padding bodies with excellent resiliently cushioning properties from thermoplastically non-deformable plastic and foam materials, such as polyurethane foam, silicone rubber, or the like, it is, for example, impossible to subsequently change their shape by heating.

SUMMARY AND ADVANTAGES OF THE INVENTION

It is therefore an object of the present invention to provide a cushioning or padding body manufactured from a thermoplastically deformable foam material, where the disadvantages described above are avoided.

This object is attained by the provision of a body composed of individual beads of the foam material. These beads are provided with a closed surface, essentially impermeable to air, and are fixed in place with respect to each other by the effects of heat by means of sintering. Thus the body comprises a plurality of completely closed cells, the surface of which, impermeable to air, encloses an air cushion. The latter acts in the manner of an air spring and mechanically stabilizes the beads by creating a counterpressure in the interior when they are deformed, and thus restoring force. For this reason the foam material can have a low relative density without losing its long-term stability. The shape in which the cushioning or padding material is to be manufactured is determined by means of the spatial fixation of the individual beads by the effects of heat by means of sintering. Sintering means that the beads are baked together at their respective contact surfaces.

The cushioning or padding body according to the present invention has a plurality of excellent properties with respect to its use. These are superior cushioning properties, great restoration ability, even after multiple and heavy stress due to pressure, viscoplasticity and stability of shape, yet great flexibility and breaking resistance, little moisture absorption as well as excellent cold insulation. Based on the high degree of stability it would even be conceivable to form entire parts of a shoe completely in the manner of the subject of the present invention, such as for example the piece for the sole of a sandal. Additionally, because of the construction of the body from individual beads, the result is a structure of its surface in the shape of slight rises and depressions which have a physiologically advantageous effect on the sole of the foot, perhaps in the manner of a massaging effect, for example when the body is used as an insole. The formation of so-called reflex zones is possible without a problem in this connection. Furthermore, air can circulate over the depressions, which allows the removal of moisture. Last but not least, the particularly low weight of the cushioning or padding body according to the present invention should be stressed. Another essential advantage of the cushioning or padding body according to the present invention lies in the later ability to individually adapt the body to defined parts of the foot of the wearer of the shoe by heating.

The thermoplastically deformable beads may be made of thermoplastically deformable polyethylene foam or polypropylene foam.

A bead diameter of approximately 3 to 5 mm has proven to be a satisfactory compromise between satisfactory flexibility and shape adaptation properties. If the spheres are too small, it is possible to produce very detailed shapes, however, the flexibility properties are not satisfactory. If the spheres are too large, there is a good padding effect, but certain detailed shapes can no longer be made.

The cushioning or padding body may also be manufactured from the thermoplastically deformable beads, mixed with a resiliently cushioning, thermoplastically non-deformable plastic material. This means that the beads are embedded in a lattice made of the above recited plastic material. The material properties of the cushioning body are further improved with this, because the increased long-term stability of the resiliently cushioning plastic material is advantageously combined with the ability of thermoplastic deformability of the beads. In this way it is possible to subsequently thermoplastically deform the cushioning body within certain limits.

An advantageous mixing ratio between the beads and the thermoplastically non-deformable plastic material of approximately 50:50 is possible. Silicone rubber is advantageously used for this plastic material which, besides thermoplastic non-deformability, has particularly advantageous properties as a basic material for cushioning and padding bodies for use as shoes. If the silicone rubber is being hot cured, its cross-linking and the sintering of the beads can take place in one operational step.

A method for manufacturing a cushioning or padding body from thermoplastically resilient deformable beads in accordance with the invention is also contemplated. In accordance with this method the beads are introduced into a mold, completely filling it, and their position relative to each other is subsequently fixed by sintering with the application of heat, preferably at a temperature of 110°.

The same advantage holds for manufacturing a cushioning or padding body from a mixture of thermoplastically deformable beads and a thermoplastically non-deformable plastic material. After introducing the mixture into a mold for the body, cross-linking of the thermoplastically non-deformable material by means of applying heat and with inclusion and, if desired, sintering of the beads. In this way the shape of the body is in itself fixed by the lattice formed by the thermoplastically non-deformable plastic material. Nevertheless, there is the possibility of subsequent adaptation by means of a change in the shape of the body.

The beads or the mixture of beads and thermoplastically non-deformable plastic material are introduced into the mold under overpressure. By means of this it is possible to optionally set the firmness of cushioning or the resilient properties prior to sintering or cross-linking of the base material by variation of the overpressure. With high overpressure, a very dense structure of the material with correspondingly little resiliency is the result and vice versa.

The use of the thermoplastically deformable beads for the cushioning or padding body makes it possible to adapt it individually and exactly to the respective shape of a corresponding part of the foot of the wearer of the shoe. In this case a cushioning or padding body corresponding to the rough anatomical shape of the respective part of the foot is manufactured. The rough shape is necessary because the cushioning body, whether made exclusively from thermoplastically deformable beads or from the previously described mixed material, no longer can freely flow thermoplastically because of the mutual fixing of the position of the beads or the formation of the lattice. A change of shape is only possible within certain limits, provided by the resilient properties of the beads or of the thermoplastically non-deformable plastic. However, as a rule this is sufficient for exact fitting. For this purpose the cushioning or padding body is brought into contact with the respective part of the foot while being heated and is exactly fitted by means of its thermoplastic ability. After cooling, the exactly fitted shape of the cushioning or padding body is impressed in a resiliently cushioning, but stable as to shape, form. It should be pointed out that when mixed material is used, fitting becomes possible because in the heated state the thermoplastically deformable beads pull, so to speak, the lattice into the exact shape and maintain it in this shape after cooling.

A further important advantage is that the beads have a sort of shape memory. After thermoplastic deformation under pressure and repeated application of heat in a pressure-free state they have a tendency to return into their original shape.

Exact fitting of the cushioning or padding body takes place directly inside the shoe. By means of this the body is adapted to the shape of the foot as well as to the respective shape of the adjoining inner surface of the shoe in one operation.

A method for the simultaneous manufacture and exact fitting of the cushioning or padding body is also contemplated. This may be used, for example, during manufacture and exact fitting of the inner shoe of a ski boot having an envelope for an adaptable filler located between the outer shell of the boot and the foot. In this way this envelope of the inner shoe, inserted into the ski boot, can be filled with thermoplastically deformable beads or the mixed material, if desired under pressure, with the foot also inserted. Then the beads or the mixed material are positionally fixed by the application of heat and the cushioning or padding body is correspondingly exactly fitted. If the exact fitting was not satisfactory, the procedure can be optionally repeated by renewed application of heat.

BRIEF DESCRIPTION OF THE DRAWING

The invention will be described by an exemplary embodiment by means of the attached drawing. The latter shows a perspective view of an insole.

DETAILED DESCRIPTION

The totality of the insole 1 is comprised of a plurality of beads 2 of polyethylene foam, only a portion of which is shown in the drawing for the sake of simplicity. The beads 2 have a generally smooth surface 3, impermeable to air. The mutual contact surfaces of the beads have been sintered together by the application of heat, i.e. baked on each other, by means of which the illustrated shape of the sole is maintained.

The insole 1 in the rough shape illustrated is mainly made with indentations 4 for the toes, raised reflex zones 5 and an upwardly bent edge 6 of the sole. To this end a corresponding mold is filled under slight overpressure with the beads 2 and the sintering process is performed with the application of heat at a temperature of approximately 110° C. The insole 1 can be removed from the mold after cooling, when it has attained the shape shown in the drawing. Individual shape fitting can be performed by renewed heating to approximately 60° to 80° C.

By placing the foot on the insole 1 inside the shoe, it is possible to thermoplastically deform the individual beads and thus the sole itself within the limits set by their mutual fixation in place and the deformability of the individual beads. Besides fitting the top side 7 to the foot of the wearer of the shoe, an adaptation of the underside 8 to the inner surface of the shoe sole takes place.

What is claimed is:

1. A cushioning or padding body for insertion into footwear, consisting of a thermoplastically deformable, resiliently cushioning foam material comprising a plurality of individual foam material beads each provided with a closed surface and each being generally impermeable to air, said cushioning or padding body being formed by the process of:

introducing a plurality of said beads into a mold having a desired body shape and filling the mold; and applying heat to the mold to sinter the beads causing cross-linking of the beads, thereby fixing the beads in their position relative to each other.

2. The cushioning or padding body as defined in claim 1, wherein the beads comprise thermoplastically deformable polyethylene foam.

3. The cushioning or padding body as defined in claim 1, wherein the beads comprise thermoplastically deformable polypropylene foam.

4. The cushioning or padding body as defined in claim 1, wherein the beads have a diameter of approximately 3 to 5 mm.

5. The cushioning or padding body as defined in claim 1, wherein the heat is applied at a temperature of approximately 110° C.

6. The cushioning or padding body as defined in claim 1, wherein the beads are introduced into the mold under overpressure.

7. A cushioning or padding body for insertion into footwear, consisting of a thermoplastically deformable, resiliently cushioning foam material mixed with a resiliently cushioning, thermoplastically non-deformable plastic material, said thermoplastically deformable, resiliently cushioning foam material comprising a plurality of individual foam material beads each provided with a closed surface and each being generally impermeable to air, said cushioning or padding body being formed by the process of:

introducing a mixture comprising a plurality of said beads and said non-deformable plastic material into a mold having a desired body shape and filling the mold; and applying heat to the mold to sinter the beads causing cross-linking of the beads and said non-deformable plastic material, thereby fixing the beads and the non-deformable plastic material in their position relative to each other.

8. The cushioning or padding body as defined in claim 7, wherein the beads comprise thermoplastically deformable polyethylene foam.

9. The cushioning or padding body as defined in claim 7, wherein the beads comprise thermoplastically deformable polypropylene foam.

10. The cushioning or padding body as defined in claim 7, wherein the beads have a diameter of approximately 3 to 5 mm.

11. The cushioning or padding body as defined in claim 7, wherein the mixing ratio is approximately 50:50.

12. The cushioning or padding body as defined in claim 7, wherein the resiliently cushioning, thermoplastically non-deformable plastic material comprises silicone rubber.

13. The cushioning or padding body as defined in claim 7, wherein the heat is applied at a temperature of approximately 110° C.

14. The cushioning or padding body as defined in claim 7, wherein the beads and non-deformable plastic material are introduced into the mold under overpressure.

15. A method for the exact fitting of a cushioning or padding body to the respective shape of a corresponding part of the foot of a wearer, said cushioning or padding body consisting of a thermoplastically deformable, resiliently cushioning foam material comprising a plurality of individual foam material beads each provided with a closed surface and each being generally impermeable to air and fixed in their position relative to each other by the effect of heat, the method comprising the steps of:

introducing a plurality of thermoplastically deformable, resiliently cushioning foam material beads into a mold having a desired body shape and filling the mold;

applying heat to the mold to sinter the beads causing cross-linking of the beads, thereby fixing the beads in their position relative to each other and such that the fixed beads correspond to the rough anatomical shape of the respective part of the foot;

removing the body in a heated state from the mold and bringing it into contact with the respective part of the foot for each fitting of the body to the respective part of the foot; and cooling the exact fitting body thereby forming a resilient but stable shape.

16. The method as defined in claim 15, wherein the exact fitting takes place inside a shoe.

17. The cushioning or padding body as defined in claim 15, wherein the heat is applied at a temperature of approximately 110° C.

18. A method for the exact fitting of a cushioning or padding body to the respective shape of a corresponding part of the foot of a wearer, said cushioning or padding body consisting of a thermoplastically deformable, resiliently cushioning foam material mixed with a resiliently cushioning, thermoplastically non-deformable plastic material, said thermoplastically deformable, resiliently cushioning foam material comprises a plurality of individual foam material beads each provided with a closed surface and each being generally impermeable to air, said beads being fixed in their position relative to each other by the effect of heat, the method comprising the steps of:

introducing a mixture comprising a plurality of thermoplastically deformable, resiliently cushioning foam material beads and resiliently cushioning, thermoplastically non-deformable plastic material into a mold having a desired body shape and filling the mold;

applying heat to the mold to sinter the beads to cause cross-linking of the beads and the non-deformable plastic material, thereby fixing the beads and the non-deformable plastic material in their position relative to each other and such that the cross-linked beads and non-deformable plastic material correspond to the rough anatomical shape of the respective part of the foot;

removing the body in a heated state from the mold and bringing it into contact with the respective part of the foot for exact fitting of the body to the respective part of the foot; and cooling the exact fitting body thereby forming a resilient but stable shape.

19. The method as defined in claim 18, wherein the exact fitting takes place inside a shoe.

20. A method for the simultaneous manufacture and exact fitting of a cushioning or padding body to the respective shape of a corresponding part of the foot of the wearer of a ski boot, the body consisting of a thermoplastically deformable, resiliently cushioning foam material comprising a plurality of individual foam material beads each provided with a closed surface and each being generally impermeable to air, said beads being fixed in their position relative to each other by the effect of heat, the method comprising the steps of:

providing an envelope of the inner shoe of the ski boot situated between the outer shell of the ski boot and the foot, and filling the envelope with the beads; and applying heat to the envelope to sinter the beads causing cross-linking of the beads thereby fixing the beads in their position relative to each other.

21. A method for the simultaneous manufacture and exact fitting of a cushioning or padding body to the respective shape of a corresponding part of the foot of the wearer of a ski boot, the body consisting of a thermoplastically deformable, resiliently cushioning foam material mixed with a resiliently cushioning, thermoplastically non-deformable plastic material, said thermoplastically deformable, resiliently cushioning foam material comprises a plurality of individual foam material beads each provided with a closed surface and each being generally impermeable to air, said beads being fixed in their position relative to each other by the effect of heat, the method comprising the steps of:

providing an envelope of the inner shoe of the ski boot situated between the outer shell of the ski boot and the foot, and filling the envelope with a mixture of the beads and the resiliently cushioning, thermoplastically non-deformable plastic material; and applying heat to the envelope to sinter the beads to cause cross-linking of the beads and the non-deformable plastic material, thereby fixing the beads and the non-deformable plastic material in their position relative to each other.

* * * * *